United States Patent [19]

Van Ackeren

[11] 4,016,045

[45] Apr. 5, 1977

[54] COKE OVEN DOOR SEALING SYSTEM

[75] Inventor: Joseph Van Ackeren, Allison Park, Pa.

[73] Assignee: Koppers Company, Inc., Pittsburgh, Pa.

[22] Filed: Feb. 18, 1976

[21] Appl. No.: 658,928

[52] U.S. Cl. ..... 202/242; 110/173 R; 110/175 R; 122/498; 202/248; 202/269

[51] Int. Cl.[2] ..... C10B 1/06; C10B 25/06; C10B 25/16; C10B 29/00

[58] Field of Search ..... 202/242, 243, 247, 248, 202/269, 263; 110/173 R, 175 R; 122/498

[56] References Cited

UNITED STATES PATENTS

| | | | |
|---|---|---|---|
| 2,571,597 | 10/1951 | Millard | 202/248 X |
| 2,778,785 | 1/1957 | Otto | 202/248 |
| 3,933,595 | 1/1976 | Gordon et al. | 202/263 X |

FOREIGN PATENTS OR APPLICATIONS

| | | | |
|---|---|---|---|
| 738,975 | 9/1943 | Germany | 202/248 |
| 905,605 | 3/1954 | Germany | 202/248 |
| 4,929,585 | 9/1970 | Japan | 202/248 |
| 681,073 | 10/1952 | United Kingdom | 202/248 |

*Primary Examiner*—Morris O. Wolk
*Assistant Examiner*—Michael S. Marcus
*Attorney, Agent, or Firm*—Sherman H. Barber; Oscar B. Brumback

[57] ABSTRACT

A sealing arrangement for a door of a coke oven chamber includes a fluid channel around the door carrying gases from a coke oven chamber. Means is provided that subdivides the channel into separate fluid channelways and means is provided for conducting the gases from each channelway into an adjacent end heating flue in the heating walls defining the coke oven chamber.

6 Claims, 2 Drawing Figures

COKE OVEN DOOR SEALING SYSTEM

BACKGROUND OF THE INVENTION

1. Field of the Invention

The present invention relates to coke ovens and, more particularly, to an improved sealing system for the doors on a coke oven chamber.

2. Description of the Prior Art

The prior art is replete with seals for doors of coke oven chambers. However, most if not all of the seals that have been disclosed in the prior art exhibit a common idea, namely, to either divert the coke oven gas that leaks past a door sealing device into the coke oven chamber, or to pressurize a channel forming the seal so as to prevent coke oven gas from escaping to the outside atmosphere. Many various designs of seals that attempt to accomplish effective sealing of a coke oven door are kown, but no coke oven door seals are kown that embody the concept of the present invention.

SUMMARY OF THE INVENTION

The periphery of a coke oven door carries a channel that coacts with a sealing surface of a coke oven door jamb. The channel is resiliently biased into contact with the door jamb sealing surface when the door is placed in operative position. The channel is provided with divider plates at the top and bottom of the door, thereby forming at least two separate fluid channels or channelways.

The door jamb is provided with one or more ports communicating with each separate channelway, and each port communicates with a passageway through the jamb brick or bricks in the end flue wall leading into the end heating flue. Thus, one or more gas passages are provided in the door jamb and end flue walls so that coke oven gases in the separate channels flow into the end flues on either side of the coke oven chamber.

For a further understanding of the invention and for features and advantages thereof, reference may be made to the following description and the drawings which illustrate a preferred embodiment of apparatus in accordance with the invention.

DETAILED DESCRIPTION

Figure 1:
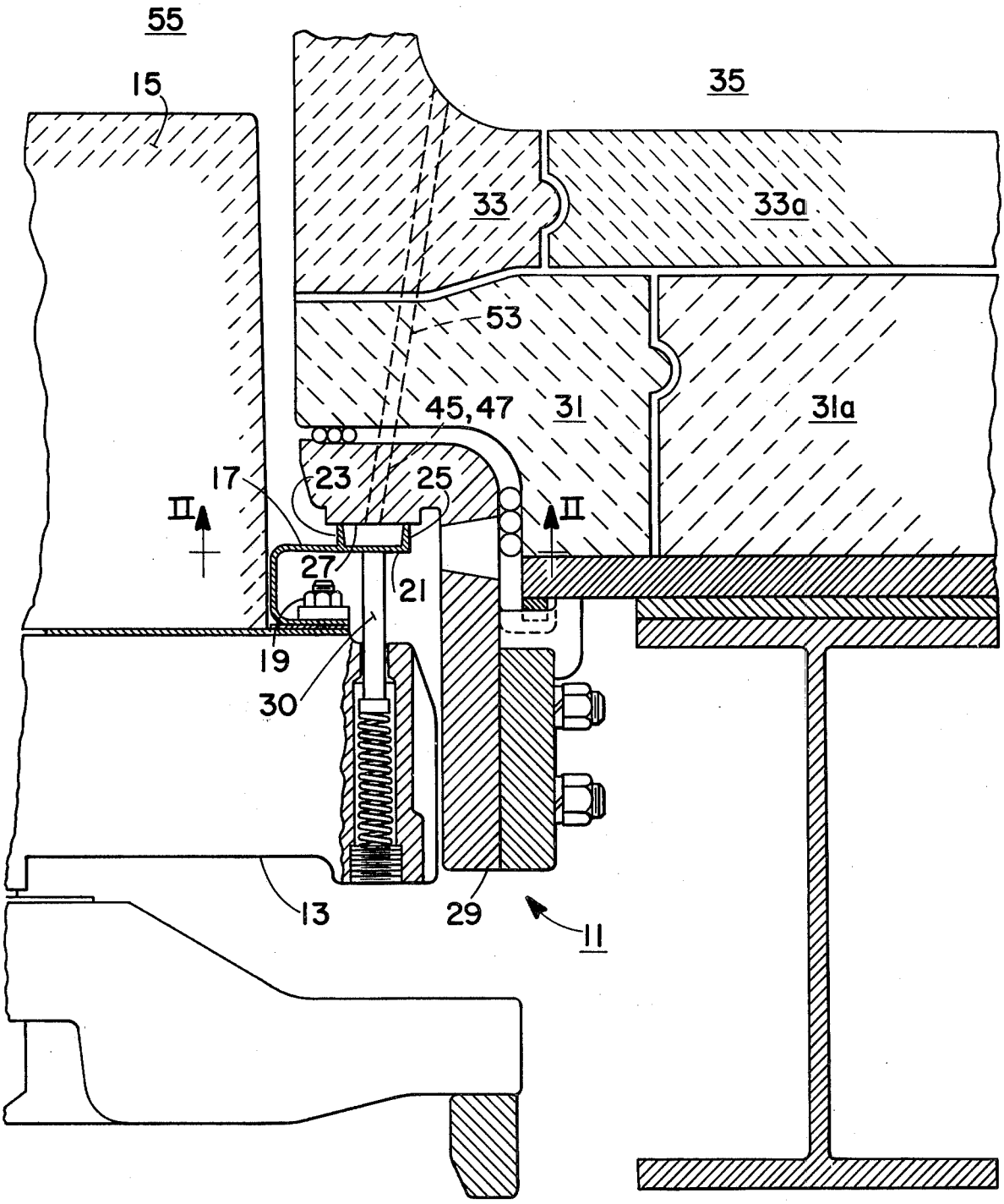
FIG. 1 is a horizontal transverse section of one side of a coke oven door and the end flue wall structure, showing an embodiment of the invention.

Referring to FIG. 1, a conventional coke oven door 11 includes a door frame 13 that supports a refractory door plug 15 and a resilient sealing strip 17.

The sealing strip 17, in the embodiment of the invention selected for illustrative purposes herein, is generally U-shaped in form, as shown, and is mounted along the peripheral edge of the door frame 13 by suitable fasteners 19 secured to the door frame. The other edge of the sealing strip is also U-shaped, but is formed as a structural channel 21; both legs 23, 25 of the U-shape or channel 21 coacting in sealing relation with a sealing surface 27 of a conventional door jamb 29 under the influence of resiliently biased plungers 30.

The door jamb 29 is mounted in a conventional manner to jamb bricks **31, 31*a*, and 33, 33*a* of the end wall of end flue 35. While only one side of the door 11** has been shown, those skilled in the art recognize that the other side of the door is the same, but to opposite hand.

Figure 2:
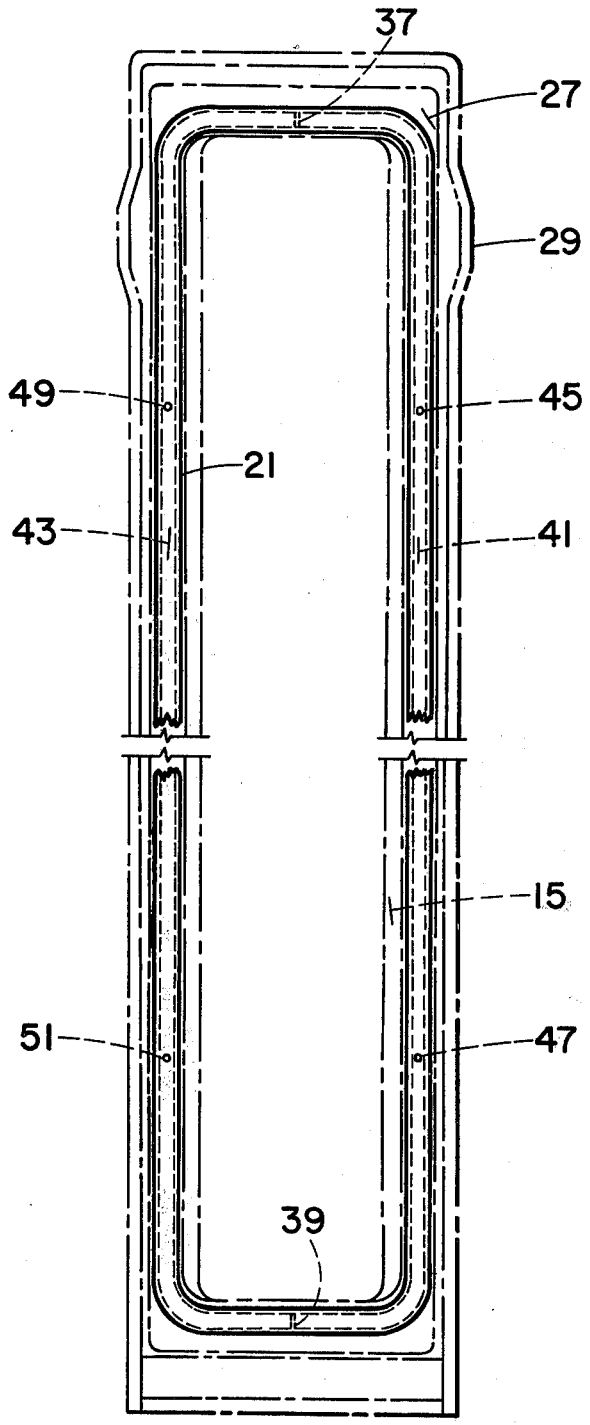
FIG. 2 is an elevational view along line II—II of FIG. 1 showing a simplified structure of the coke oven door; much conventional structure being omitted for reasons of clarity, in order to show the principle of the invention.

In accordance with the invention, the channel 21 is provided with a top baffle 37 and a bottom baffle 39 that effectively divide the channel 21 into two separate, right and left, gas carrying channelways 41, 43 respectively, as viewed in FIG. 2.

The door jamb 29 is provided with a pair of passageways 45, 47 communicating with the right channelway 41 and with another pair of passageways 49, 51 communicating with the left channelway 43.

The passageways 45, 47 and 49, 51 communicate respectively with passageways, like passageway 53, in the jamb bricks 31, 33, and such passageways lead to the end flue 35 on the right hand side of oven chamber 55 and, in like manner, (though not shown) with the end flue on the left hand side of oven chamber 55 as viewed in FIG. 1.

Thus, when coal is being coked in the oven chamber 55, the end flue 35 will, in accordance with conventional coking practice, be both an "on-flue" and an "off-flue", according to the conventional reverse heating cycle. Likewise, the end flue on the other side of oven chamber 55 will be at the same time both an off-flue and an on-flue. Thus, when the end flues are on-flues, gas is burned in them which creates an upward flow of gases and a vacuum condition is created in the passageways and channelways connected to the end on-flues. A similar vacuum condition is created in the passageways and channelways connected to the end off-flues due to the downward flow of gases in such end flues.

Thus, any coke oven gas that leaks past the seal between leg 23 and the surface 27 will be withdrawn from the respective channelways by the vacuum condition resulting from the flow of gases, either upward or downward, in the end flues.

Because there is a top baffle 37 and a bottom baffle 39, gases in channelway 41 cannot flow around the top and the bottom portions of the door and into channelway 43 on the other side. Therefore, circulation between a burning end on-flue and an end off-flue is prevented, but gases in the channelways is exhausted nonetheless.

While the invention herein has been described with respect to a channel divided at the top and bottom into two separate side channelways, it is understood that the channel may be subdivided in other ways, if preferred.

From the foregoing description of one embodiment of the invention, those skilled in the art should recognize many important features and advantages of it, among which the following are particularly significant:

That coke oven gas flowing past a sealing strip coacting with a sealing surface of a door jamb is withdrawn into the end heating flue and burned there during the on heating cycle;

That the normal upward flow (during the on cycle) and the downward flow (during the off cycle) of gases in the end heating flues induces coke oven gas around the door to flow into the end heating flues and not into the atmosphere;

That the coke oven gas that leaks into the channelways is contained within the coke oven battery and does not escape to atmosphere where it might burn at the door periphery; and That the coke oven gas that is conveyed into the end flues enhances heating in the on-flue and also enhances heating the gases flowing in the off-flue into the regenerators.

Although the invention has been described herein with a certain degree of particularity it is understood that the present disclosure has been made only as an example and that the scope of the invention is defined by what is hereinafter claimed.

What is claimed is:

1. In combination, a coke oven having a chamber for coking coal and generating coke oven gases and a coke oven door sealing arrangement, said coke oven chamber having a coke oven door at one end thereof and heating flues at both sides thereof, said door coacting with a door jamb mounted cooperatively with an end brick structure of said heating flues at the ends thereof adjacent to said door, said coke oven door sealing arrangement comprising, a. a U-shaped sealing strip carried by said door that cooperates with a sealing surface of said door jamb and forms a fluid channel around said door;

b. means dividing said channel into separate fluid channelways; and c. means fluidly communicating each one of said channelways with a respective end flue, whereby coke oven gases in said channelways flow into said end flues.

2. The invention of claim 1 wherein:

a. said means dividing said channel includes both a top and a bottom baffle in said channel.

3. The invention of claim 1 including:

a. means urging said sealing strip into cooperative action with said door jamb sealing surface.

4. The invention of claim 1 wherein:

a. said means fluidly communicating each one of said channelways is a passageway in said door jamb and a connecting passageway in said end jamb brick structure that terminates in an end flue.

5. The invention of claim 1 wherein:

a. said means communicating with a respective end flue are a plurality of passageways in said door jamb that communicate respectively with passageways in said end jamb brick structure and that terminate in an end flue.

6. In combination a coke oven having a chamber for coking coal and generating coke oven gases and a coke oven door sealing arrangement, said coke oven chamber having a coke oven door at one end thereof and heating flues at both sides thereof, said door coacting with a door jamb mounted cooperatively with an end brick structure of said heating flues at the ends thereof adjacent to said door, said coke oven door sealing arrangement comprising, a. a U-shaped sealing strip carried by said door that cooperates with a sealing surface of said door jamb;

b. means urging said sealing strip into cooperation with said door jamb thereby forming a fluid channel for gases around the periphery of said door;

c. means subdividing said fluid channel into separate fluid channelways; and d. fluid passageways in said door jamb and in said end jamb brick structures that carry said gases from said separate channelways into said respective end flues.

* * * * *